US011758990B2

(12) United States Patent
Matchett

(10) Patent No.: US 11,758,990 B2
(45) Date of Patent: Sep. 19, 2023

(54) DEVICE AND METHOD FOR SECURING A ZIPPERED COMPARTMENT

(71) Applicant: HIGHCROFT INC., Calgary (CA)

(72) Inventor: Michael Kenneth Matchett, Calgary (CA)

(73) Assignee: HIGHCROFT INC., Calgary (CA)

( * ) Notice: Subject to any disclaimer, the term of this patent is extended or adjusted under 35 U.S.C. 154(b) by 159 days.

(21) Appl. No.: 17/332,364

(22) Filed: May 27, 2021

(65) Prior Publication Data

US 2021/0282509 A1 Sep. 16, 2021

Related U.S. Application Data

(63) Continuation-in-part of application No. 16/648,875, filed as application No. PCT/CA2018/051162 on Sep. 18, 2018, now abandoned.

(60) Provisional application No. 62/560,338, filed on Sep. 19, 2017.

(51) Int. Cl.
*A44B 19/30* (2006.01)

(52) U.S. Cl.
CPC ..... *A44B 19/303* (2013.01); *A44B 19/305* (2013.01)

(58) Field of Classification Search
CPC ..... A44B 19/303; A44B 19/305; A44B 19/30
See application file for complete search history.

(56) References Cited

U.S. PATENT DOCUMENTS

| | | | | | |
|---|---|---|---|---|---|
| 4,395,891 | A * | 8/1983 | Remington | A44B 19/301 | 70/68 |
| 4,995,656 | A * | 2/1991 | Akashi | A44B 19/301 | 292/307 R |
| 5,081,855 | A * | 1/1992 | Terada | A44B 19/301 | 70/68 |
| 5,103,657 | A * | 4/1992 | Horita | A44B 19/301 | 70/68 |
| 5,681,115 | A * | 10/1997 | Diederich | B65D 33/2541 | 383/97 |
| 6,385,818 | B1 * | 5/2002 | Savicki, Sr. | B65D 33/2541 | 24/30.5 R |
| 6,431,754 | B1 * | 8/2002 | Savicki, Sr. | B65D 33/259 | 24/387 |
| 6,533,335 | B2 * | 3/2003 | Hudson | A44B 19/301 | 385/5 |
| D698,223 | S * | 1/2014 | Moreau | D8/330 | |
| 9,456,663 | B1 * | 10/2016 | Wheeler | B65D 50/045 | |
| 9,545,158 | B2 * | 1/2017 | Goldberg | A47C 31/105 | |
| 10,214,322 | B2 * | 2/2019 | Tan | B65D 33/2589 | |

(Continued)

*Primary Examiner* — David M Upchurch
(74) *Attorney, Agent, or Firm* — FIELD LLP; Charlene M. Lipchen

(57) ABSTRACT

A device releasably attachable to a zippered compartment so as to secure the compartment against unauthorized access is disclosed. The device includes an anchor for mounting the device to the zippered compartment, and a releasable lock for engaging the body of a slider head of the zippered compartment. The anchor includes a clamp, clip, and contact surfaces so as to engage a portion of the zippered closure of the zippered compartment. The releasable lock includes a latch that releasably engages the body of a standard slider head of the zippered closure. When the device is removed from the zippered compartment, the zippered closure is left in its original, unmodified condition.

18 Claims, 18 Drawing Sheets

(56) References Cited

U.S. PATENT DOCUMENTS

| | | | | |
|---|---|---|---|---|
| 2003/0014848 | A1* | 1/2003 | LaRue | B65D 33/2541 24/387 |
| 2004/0083782 | A1* | 5/2004 | Lantz | E05B 39/02 70/423 |
| 2013/0174488 | A1* | 7/2013 | Snider | B60J 1/1853 49/70 |
| 2018/0037372 | A1* | 2/2018 | Tan | B65D 33/2589 |

* cited by examiner

DEVICE AND METHOD FOR SECURING A ZIPPERED COMPARTMENT

CROSS REFERENCE TO RELATED APPLICATIONS

This application is a continuation-in-part of U.S. application Ser. No. 16/648,875 filed on Mar. 19, 2020, which is a national phase entry application of the PCT Application no. PCT/CA2018/051162 filed on Sep. 18, 2018, which PCT application claims priority from U.S. Provisional Application No. 62/560,338 filed on Sep. 19, 2017, all of which are entitled "Device and Method for Securing a Zippered Compartment", the entirety of which are incorporated herein by reference.

FIELD

The present application relates to a device and method for securing a zippered compartment, and in particular, relates to a device which is releasably attachable to a zippered compartment for securing the compartment against unauthorized access.

BACKGROUND

Children are curious beings who may frequently get into things they shouldn't. For example, various zippered bags or luggage having zippered closures, such as handbags, purses, diaper bags, backpacks, and travel bags, referred to herein collectively as zippered compartments, may contain potentially valuable and delicate goods or hazardous goods. If a zippered compartment does not have a lock or some other type of device for securing the compartment from unauthorized access, small children or other vulnerable persons may open the zippered closure and thereby gain access to the contents which may be hazardous, delicate, valuable, and/or difficult to replace. Similarly, valuables stored within zippered compartments which are unlocked, or otherwise unsecured, may be vulnerable to thieves or pick pockets who may attempt to steal the valuables contained within zippered compartments, such as purses or backpacks, carried by a person in public.

In the prior art of which the Applicant is aware, locking devices for securing zippered closures of compartments may require that the zippered compartment, for example, a purse or bag, be modified in some manner so as to attach the locking device to the zippered compartment. For example, U.S. Pat. No. 5,681,115 (the '115 patent) discloses a locking device that can be mounted to a zippered bag using threaded studs inserted through two holes in the zippered bag. The instalment of the device disclosed in the '115 patent would result in permanent modification to the bag or purse, for example. Furthermore, the installation of this device to a zippered compartment may require significant time and effort.

In other prior art of which the Applicant is aware, some locking devices require modification of the zipper slider or the zipper stop, and therefore require that a customized zipper closure arrangement be used during the manufacture of the zippered compartment. For example, in German Patent nos. 10 2010 021 631 B4 (the '631 patent) and 10 2013 106 341 B3 (the '341 patent) each disclose a modified zipper slider including a slider guide portion which is received and engaged by the zipper stop.

Additionally, German Patent no. 1 211 834 (the '834 patent) discloses a locking device with a modified pull tab on a zipper slider having a pair of slots, and a modified stopper device which has a corresponding pair of slots.

U.S. Pat. No. 5,103,657 (the '657 patent) is an example of a locking device that requires modification of both the zipper slider and the zipper stop. In the '657 patent, the illustrated embodiment includes a modified zipper slider having a hooked wing extension that extends from the front end of the zipper slider. The wing extension of the modified zipper slider engages a latch incorporated within a corresponding modified zipper stop. The '657 patent also discloses that the hooked wing extension may be incorporated into a modified stop, and the latch may be incorporated within a corresponding modified zipper slider. Furthermore, the '657 patent teaches that the stop is mounted to the zipper track by means of a screw or an adhesive. The use of a screw or an adhesive to mount the stop to the zipper tape may result in permanent modification of the zipper tape, should it be desired to remove the modified zipper stop from a zippered compartment at a later time.

US Patent Publication no. 2014/0060988 A1 (the '988 publication) discloses a locking device that does not require modification to the zippered compartment, zipper slider or zipper stop. The locking device disclosed in the '988 patent is designed to prevent the breach of a closed zipper and the subsequent concealment of the breach, for example on a piece of locked luggage travelling through an airport. The device is secured to the zippered closure by means of a pair of plates held together by fasteners, for example screws, with access to the fasteners being further secured underneath an outer cover, and then the pull tabs of the one or more zipper sliders are secured to the device by means of inserting the shackle of a padlock or other lock through apertures of the pull tabs and apertures of the device. Thus, once the device is installed to the zippered compartment, the zippered compartment is not easily accessible to children or adults, which may include for example adults who are attempting to steal valuables from unattended luggage in an airport.

SUMMARY

In one aspect of the present disclosure, a device is provided for preventing access to a zippered compartment having a zippered closure. In particular, the device is designed so as to prevent or deter access to the zippered compartment by small children or other persons who may have difficulty manipulating the device, while still allowing relatively easy access to the zippered compartment by someone with greater dexterity, such as an adult. Such a device may be particularly useful, for example, in childproofing zippered bags or other zippered compartments, so as to prevent small children from gaining access to the contents held within the bag.

Advantageously, the device may be designed to secure a zippered closure, without having to modify the zippered closure itself or the zippered compartment to which the device is being mounted. Therefore, a person wishing to have a childproofed zippered compartment, such as a purse or handbag, is not required to purchase a specially modified zipper or zippered compartment having a locking feature. Instead, the person may separately acquire the zipper locking device and attach it to an existing bag or purse having a non-child proofed zippered closure. Furthermore, the zipper locking device disclosed herein may be simply removed from the zippered compartment once childproofing is no longer required, thereby leaving the purse, handbag or other zippered compartment in its original, unmodified condition. As used herein, the phrases "original, unmodified condition"

and "original condition," refers to the original, unmodified condition a zippered compartment and its zippered closure, including all components of the zippered closure such as the zipper tape, the zipper slider head and zipper stop and the zipper track. In other words, the installation of the zipper locking device on a zippered compartment does not result in the permanent modification of the zippered compartment or its zippered closure after the zipper locking device is subsequently removed from the zippered compartment, thereby leaving the zippered compartment, and its zippered closure, in its original, unmodified condition. The phrase "original condition" includes, but is not limited to, a zippered compartment and zippered closure that is free of punctures and adhesives or residue from adhesives on the fabric of the zippered compartment adjacent the zipper tape and the zipper tape itself, and the zipper teeth remain in their original alignment and condition, after the zipper locking device of the present disclosure is removed from the zippered compartment.

Furthermore, the phrase "non-child proofed", as described herein, refers to zippered closures in which all of the components of the zippered closure, including the zipper slider head, zipper track, zipper tape and zipper stop are of a standardized design as is known in the art, without any modification that enables the locking of the slider head to another zippered closure component. As will be appreciated by a person skilled in the art, standard zippered closures do not include any feature that enables the user to temporarily immobilize the slider head from moving relative to a particular position on the zipper track or zipper tape, so as to prevent easy access to the zippered compartment. Although it is known in the art that some zippered closures include a dual slider head design, with pull tabs on each slider head having an aperture that may receive the shackle of a lock for the purpose of locking the two slider heads together so as to prevent access to the zippered compartment, as is commonly provided on luggage for example, it is understood that such locking is accomplished using a standard design of slider head and pull tabs, and that a further component, in the form of a lock that is separate from the zippered closure, is required to accomplish the locking feature. Furthermore, while it may be possible to purchase other zippered compartments, such as a backpack or a purse, having such a dual zipper slider head design, it will be appreciated that using a lock to secure such a zippered closure to discourage access is an inconvenient technique for securing the zippered compartment, as it takes time and effort for an adult to open the lock when it is desired to access the zippered compartment.

In another aspect of the present disclosure, a method of using the zipper locking device to childproof a compartment and/or inhibit access to the compartment, the compartment having a zippered closure, is also provided.

Accordingly, in one aspect a device for securing a compartment having a cavity and zippered closure is provided. The zippered closure includes a zipper track which has a zipper tape and zipper teeth. The zippered closure further includes at least one standard, unmodified slider head operatively coupled to the zipper teeth so as to selectively open and close the zippered closure. The device comprises an anchor comprising a clamp, the clamp having upper and lower portions defining a gap therebetween, the gap sized to snugly receive a portion of the zipper track so as to frictionally engage the anchor with the portion of the zipper track onto which the device is installed. The device further includes at least one releasable lock coupled to the anchor, the lock comprising a latch for releasably retaining the body of the slider head. The latch is adapted to receive and releasably retain the body of the slider head of the at least one slider head. When the anchor of the device is subsequently removed from the portion of the zipper track, the zippered closure retains its original, unmodified condition.

Accordingly, in another aspect a method for releasably securing a compartment having a zippered closure is provided. The method comprises the steps of releasably anchoring the device described in the foregoing paragraph to a portion of the zipper track, and engaging the slider head of the at least one slider with the latch of the device.

DETAILED DESCRIPTION

The present disclosure relates to a zipper locking device 10 having an anchor 12 and a releasable lock 21. The device 10 is adapted to secure a zippered closure 4, for example, a bag having a zippered compartment with a cavity C.

Figure 1:
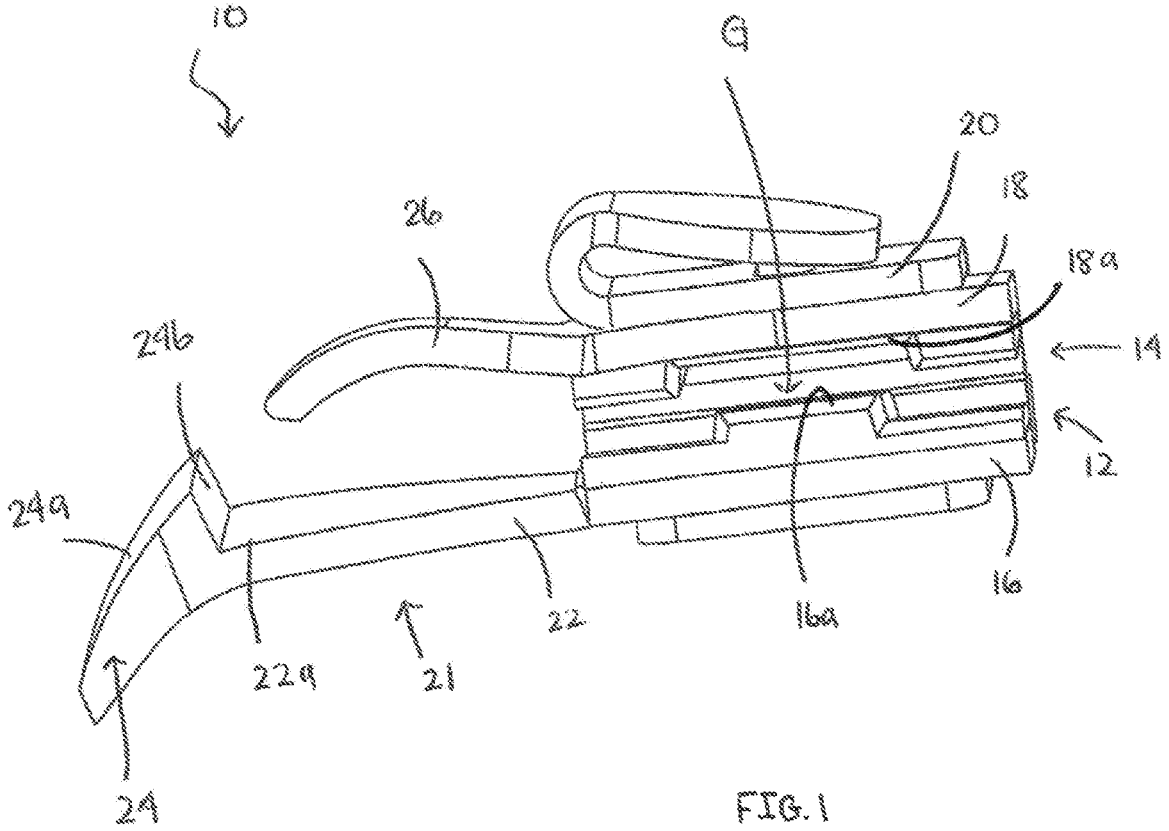
FIG. 1 is a side perspective view of an embodiment of the zipper locking device from a first direction.
Figure 2:
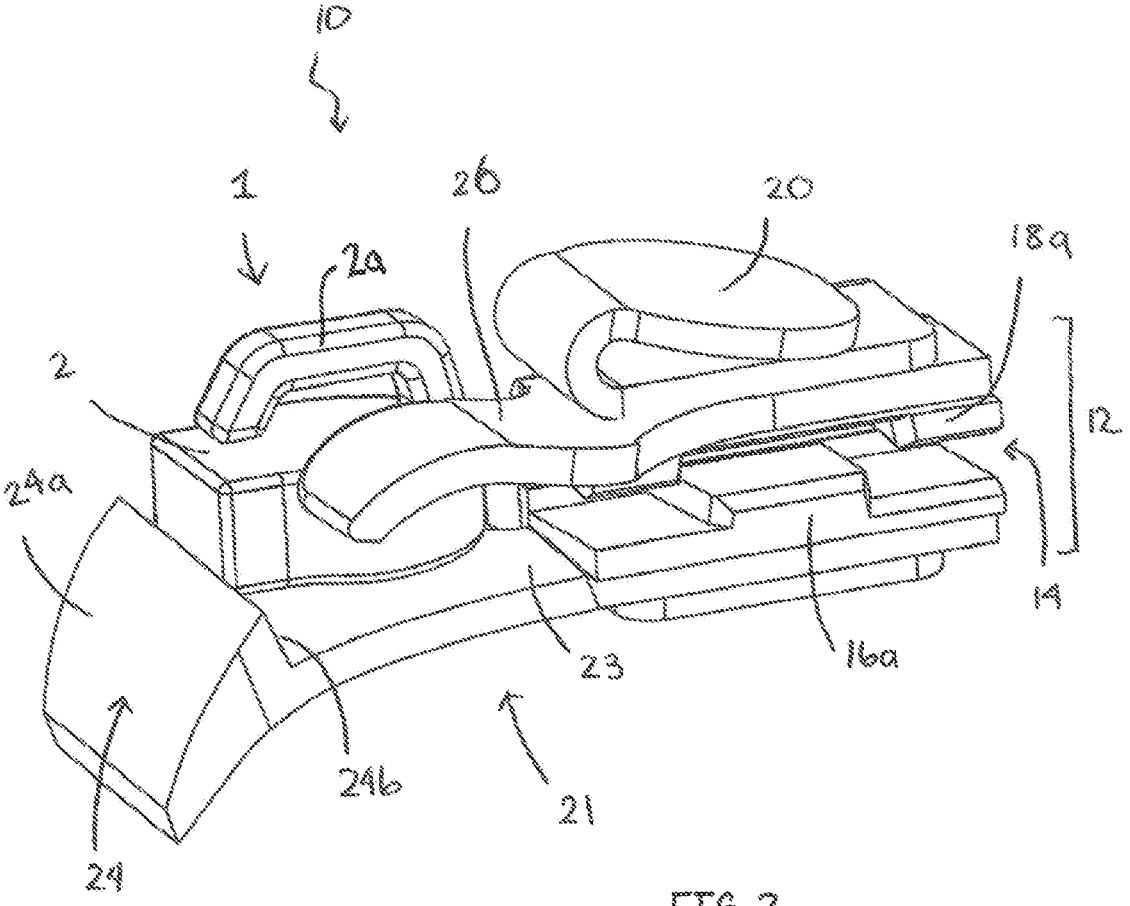
FIG. 2 is a side perspective view of the zipper locking device of FIG. 1 with a zipper slider head engaged.
Figure 5:
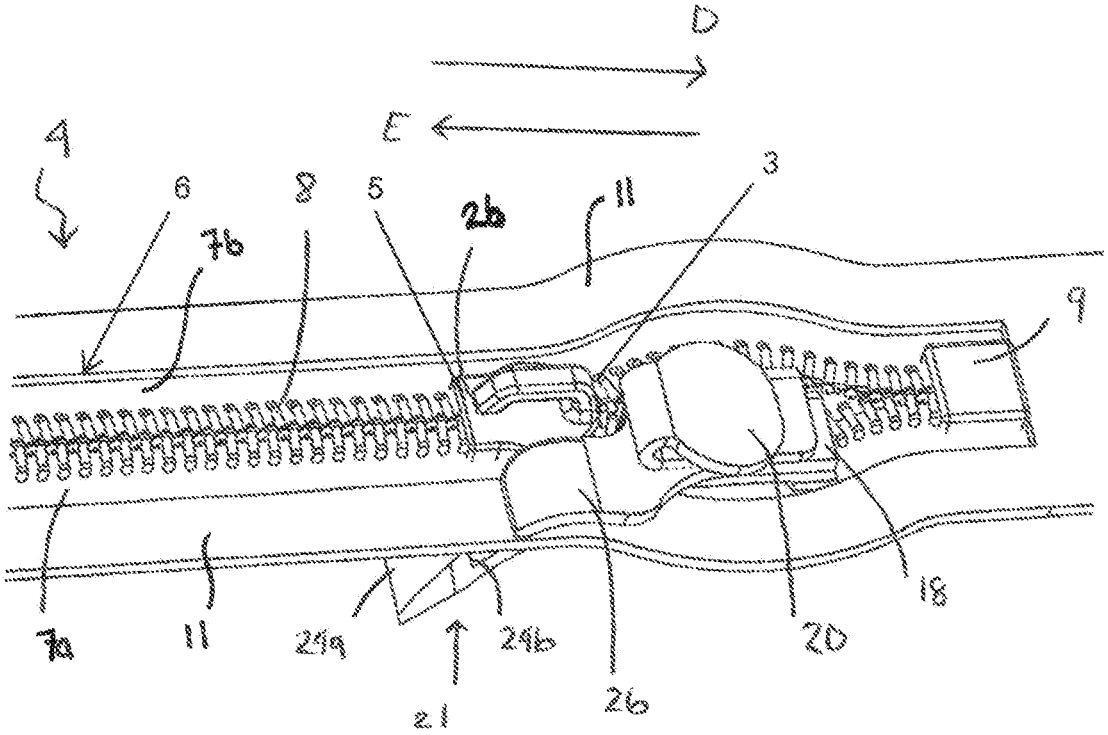
FIG. 5 is a top perspective view of the zipper locking device of FIG. 1, anchored to a zippered closure.
Figure 6:
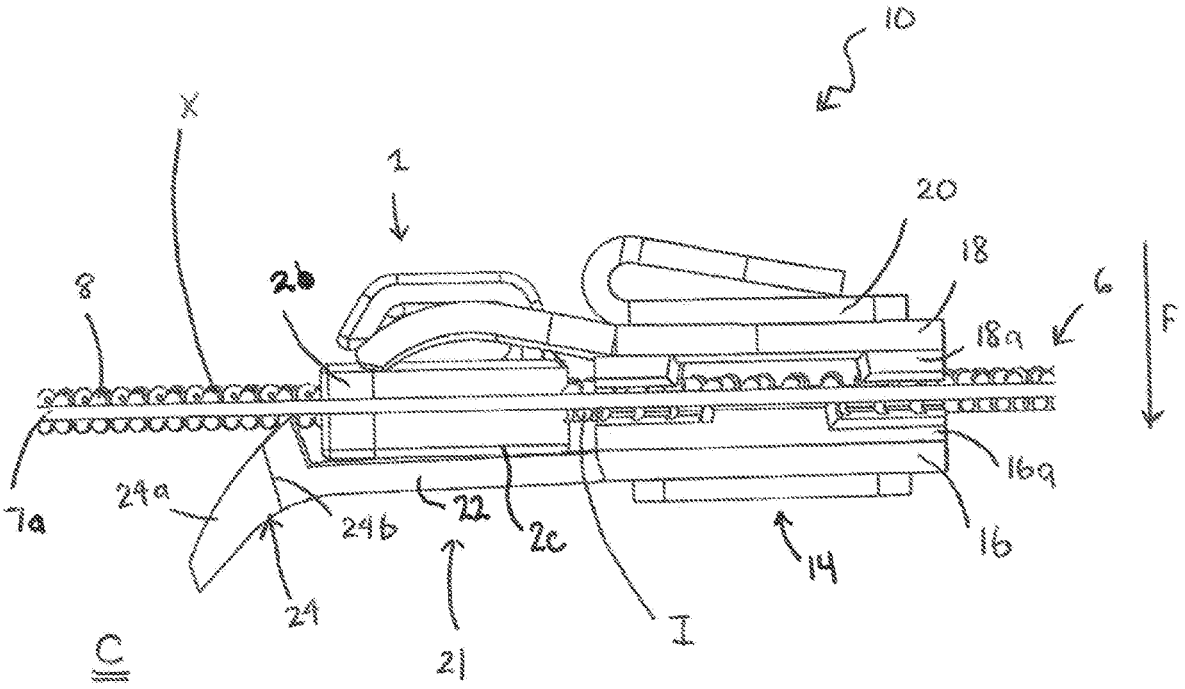
FIG. 6 is a side perspective view of FIG. 5.
Figure 7:
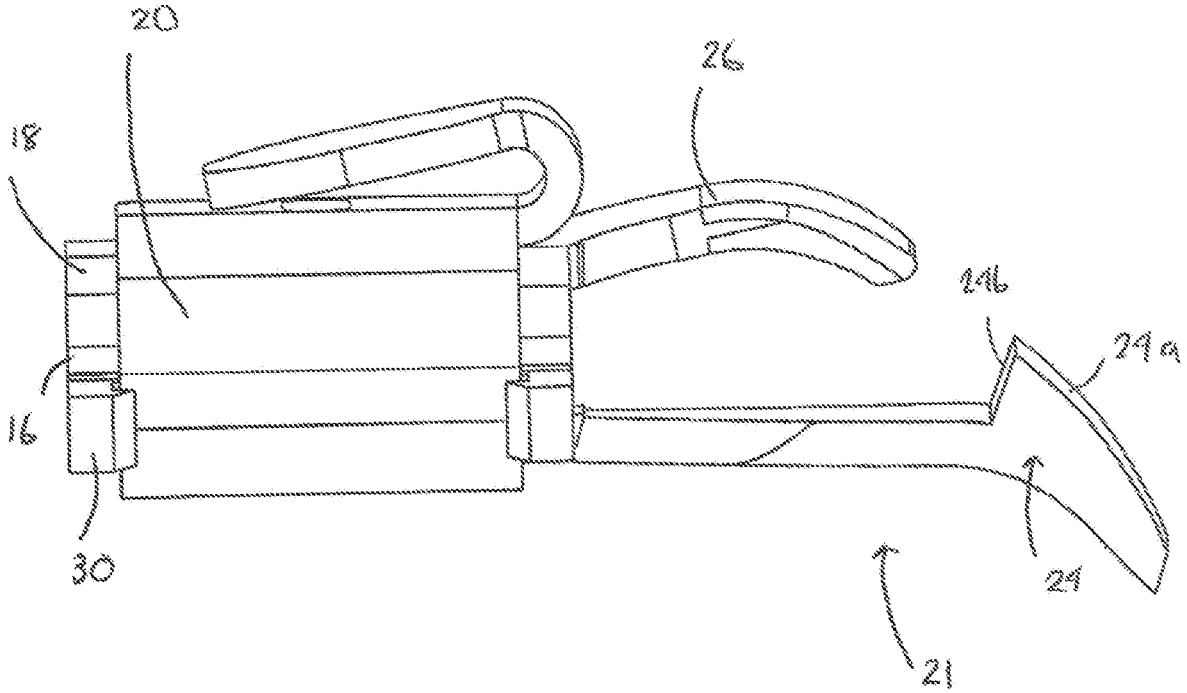
FIG. 7 is a side perspective view of the zipper locking device of FIG. 1 from another direction.

The anchor 12 is configured to be releasably mounted onto a portion of the zipper track and zipper tape of the zippered closure 4. In some embodiments, the anchor 12 includes a clamp 14. The clamp 14 may be a U-shaped clamp, as seen in FIG. 1, having an upper portion 18 and a lower portion 16. The clamp 14 includes an opening or gap G, defined between the upper portion 18 and lower portion 16 of the clamp 14, sized so as to snugly receive and frictionally engage a portion of a zippered track 6 of the zippered closure 4, so as to mount the anchor 12 to the zippered closure 4, as best seen in FIG. 6. The zipper track 6 includes first and second halves 7a, 7b of the zipper tape and zipper teeth 8, as seen in FIGS. 5 and 6. The anchor 12 may engage the zipper tape 7a and/or 7b and zipper teeth 8, and/or portions 11 of the zippered compartment adjacent the zipper tape 7a or 7b, as seen in FIG. 5.

In one embodiment, the clamp may include contact surfaces so as to increase the frictional engagement of a portion of the zipper track 6 of the zippered closure 4 by the clamp 14. For example, the clamp may include an upper contact surface 18a and a lower contact surface 16a, both surfaces adjacent to the portion of the zipper track 6 being engaged. The upper 18a and lower 16a contact surfaces may be interlocking, as seen in FIG. 1. Although not shown in the drawings, it will be appreciated that the contact surfaces 16a, 18a of the lower and upper portions 16, 18 of clamp 14 may be provided with roughened surfaces so as to increase the frictional engagement between clamp 14 and zippered closure 4 when device 10 is installed on a zippered compartment. In some embodiments, it will be appreciated that a combination of a roughened surface and/or a resilient coating may be applied to the contact surfaces 16a, 18a of the lower and upper portions 16, 18 of clamp 14 which frictionally engage the surfaces of the zippered closure 4 when the anchor 12 is in use. In a preferred embodiment, the contact surface(s) may be manufactured, for example, from a rubbery polyethylene or a thermoplastic elastomer, or any other suitable material that is resilient and thereby compressible when the clamp 14 is mounted to, so as to compress, a portion of the zipper track 6.

The upper and lower portions, 18, 16 of the clamp 14 may be compressed towards each other by mechanisms as are known to a person skilled in the art, including but not limited to worm or screw drives, springs, spring clips and rotating cam levers. In some embodiments, the upper and lower portions 18, 16 of the clamp 14 are compressed together with a clip 20, as shown for example in FIGS. 1-8.

Figure 8:
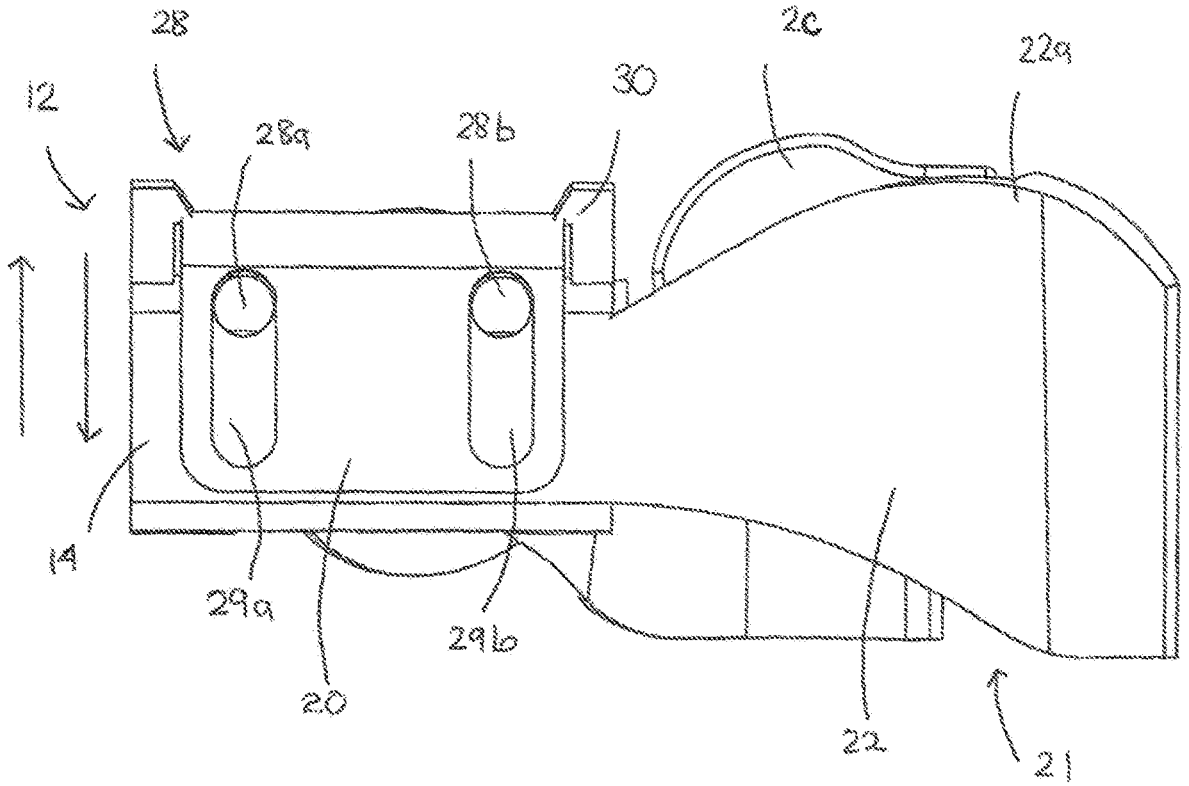
FIG. 8 is a bottom perspective view of the zipper locking device of FIG. 1.
Figure 9:
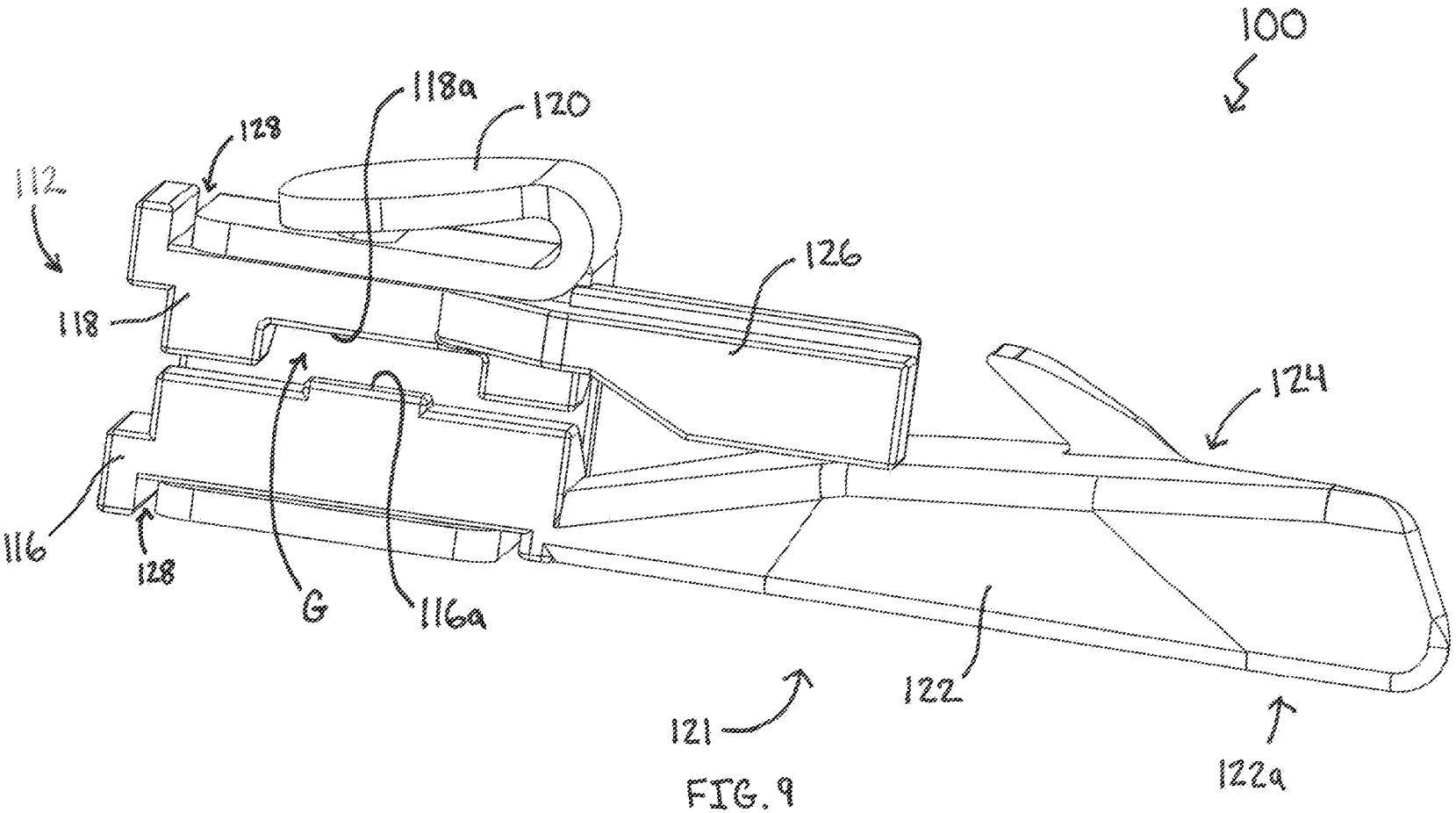
FIG. 9 is a side perspective view of a further embodiment of the zipper locking device.

Clip 20 compresses clamp 14 so as to increase the engagement between the clamp 14 and a portion of at least the zipper track 6. In one embodiment, the clip 20 may be a rigid, U-shaped clip. Clip 20 may be slidably mounted onto clamp 14 and is slideable between a locked position and an unlocked position. In the unlocked position, the clamp 14 is not compressed by clip 20, so as to widen gap G for ease of installing the clamp 14 onto the zipper track 6 or removing the clamp 14 from zipper track 6. In the locked position, clip 20 is compressing the clamp 14, so as to urge contact surface 16a towards contact surface 18a, thereby narrowing the gap G, and increasing the frictional engagement between contact surfaces 16a, 18a and the portion of the zipper track 6 that is gripped therebetween. In some embodiments, clip 20 may slide between the unlocked and locked positions along a track 28, in directions A and B respectively. Without intending to be limiting, as seen in FIG. 8, track 28 may include two protrusions 28a, 28b on the lower portion 16 of the clamp, and two corresponding slots or receptacles 29a, 29b on the clip 20 wherein rotation of clip 20 is limited by the protrusions 28a, 28b received in the slots or receptacles 29a, 29b when the clip 20 is installed on the clamp 14. Further, clamp 14 may include at least one protrusion 30, adapted to limit movement of clip 20 in directions A and B and to further assist with retaining the clip 20 on clamp 14.

In some embodiments, clip 20 may be a spring loaded clip adapted to exert a downward force on clamp 14 when in the locked position. In other embodiments, the clip 20 may be a rigid, U-shaped clip, sized so as to snugly receive the lower and upper portions 16, 18 of clamp 14.

As best viewed in FIG. 6, the zipper track 6 includes an exterior surface X and an interior surface I, wherein the exterior surface X and the interior surface I are in opposed facing relation and the interior surface I is adjacent the cavity C of the compartment. The releasable lock 21 of the zipper locking device 10 is adapted to engage the zipper slider 1 of a zippered closure 4, as shown for example in FIGS. 2, 4, 5, and 6. In one aspect of the present disclosure, the releasable lock 21 may include a resiliently flexible slider guide 22, the slider guide extending cantilevered from the lower portion 16 of the clamp 14. The resiliently flexible slider guide 22 includes a distal end 22a, distal from the anchor 12 of the device 10, the distal end 22a including a latch 24. In an embodiment of the present disclosure, the latch 24 includes a smooth outer ramp portion 24a and an upwardly extending lip or ridge 24b opposite the smooth ramp portion 24a, as shown in FIGS. 1 and 8. The releasable lock 21 extends along the interior surface I of the zippered track 6, below the exterior surface X, when the anchor is mounted to the zippered closure 4. In other words, the releasable lock 21 extends within cavity C of the zippered compartment.

The device 10 may further include at least one resilient retaining arm 26, the retaining arm 26 extending cantilevered from the upper portion 18 of the clamp and in opposed facing relation to the slider guide 22. The retaining arm 26 extends along the exterior surface X of the zippered track 6, so as to abut at least the zipper tape 7a and/or 7b. In some cases, the retaining arm 26 may abut portions of the zippered compartment 11 adjacent the zipper tape 7a and/or 7b. The retaining arm 26 exerts a downward pressure on the body of the slider head. When slider head 2 is engaged by releasable lock 21, the downward pressure exerted by the retaining arm 26 assists in maintaining engagement between the device 10 and the slider head 2. In some embodiments, the retaining arm 26 is advantageously resilient so as to be capable of flexing or deflecting in direction B, which enables the retaining arm 26 of device 10 to accommodate different sizes and shapes of slider heads 2.

Figure 3:
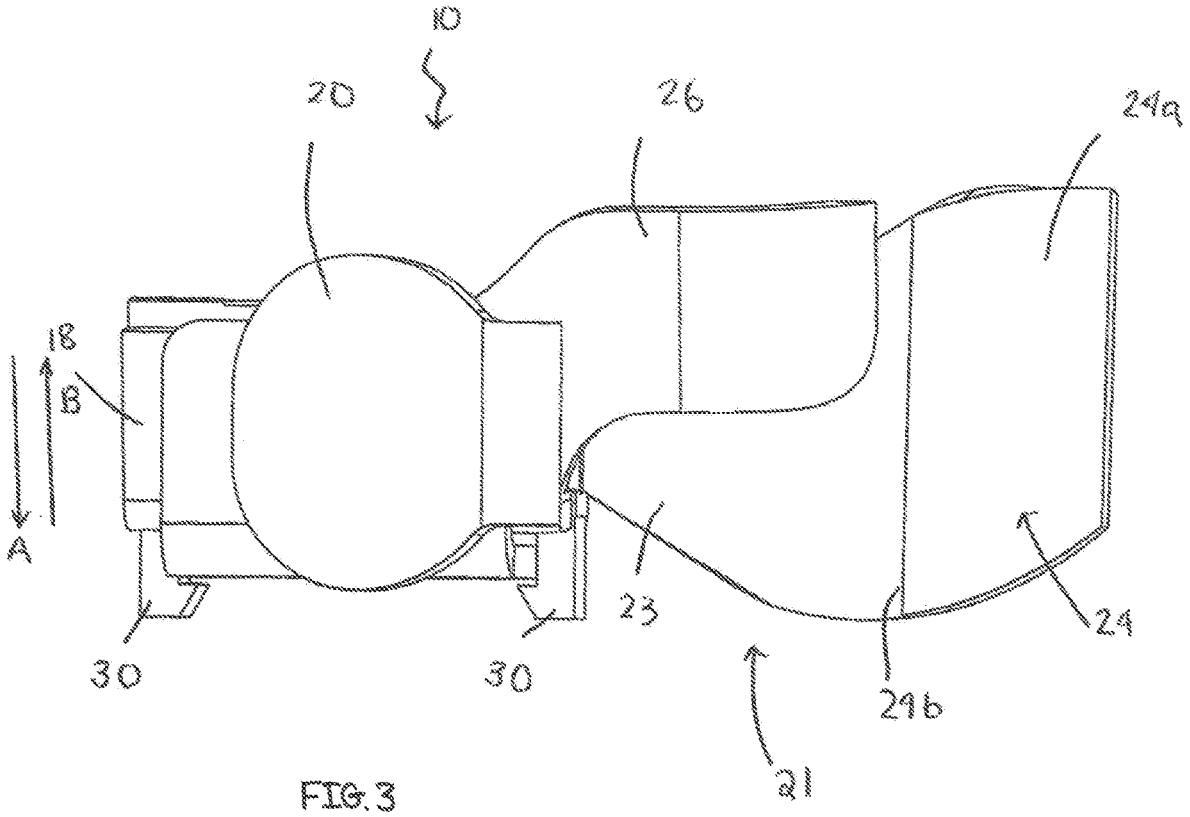
FIG. 3 is a top perspective view of the zipper locking device of FIG. 1.
Figure 4:
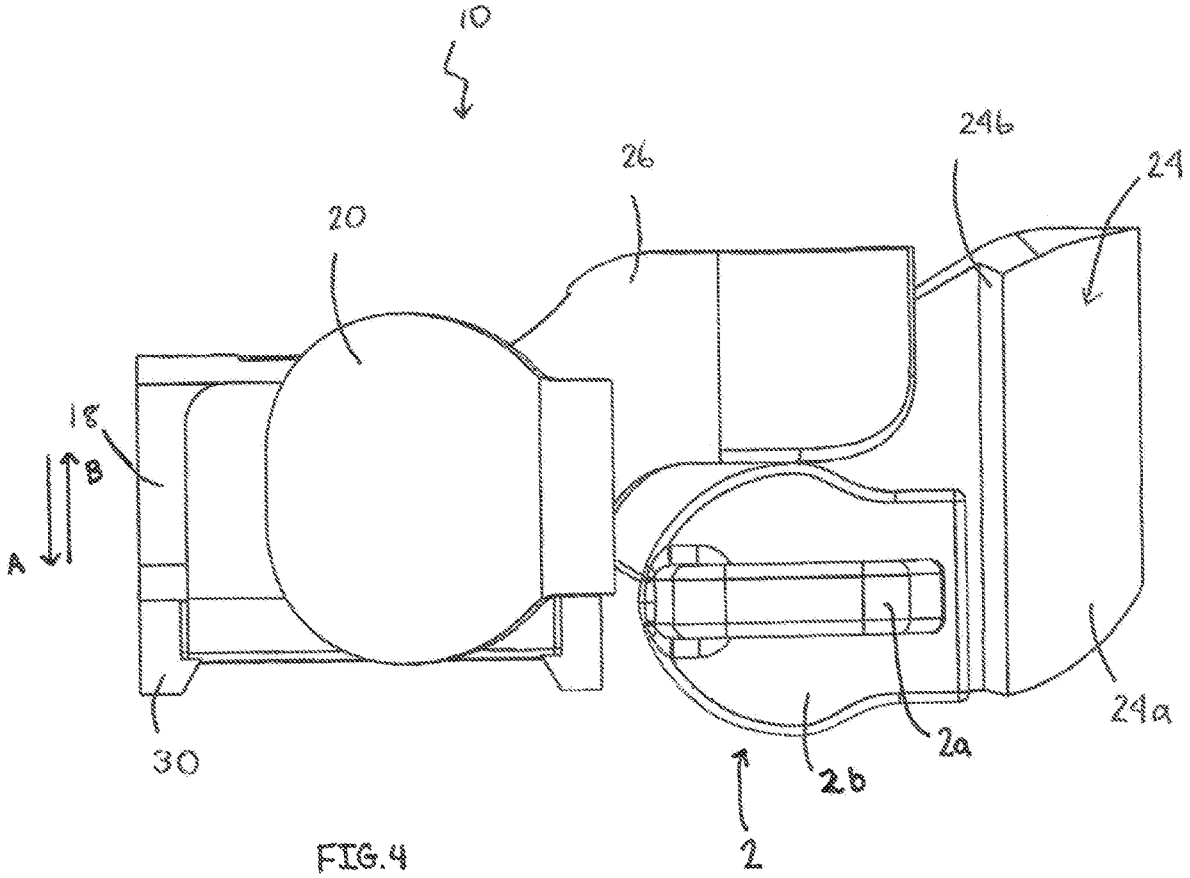
FIG. 4 is a top perspective view of the zipper locking device of FIG. 1 with a zipper slider head engaged.

In use, the zipper locking device 10 may be installed on a zippered compartment by, firstly, anchoring the device 10 to the zippered closure 4, and then engaging the slider 1 of the zippered closure with the releasable lock 21. To install the anchor 12 of the device 10 illustrated in FIGS. 1-8, clip 20 is configured to the unlocked position by sliding the clip 20 along track 28 in direction A, as seen in FIG. 3. Then a portion of the zipper tape 7a or 7b, zipper teeth 8 and/or portions 11 of the zippered compartment adjacent the zipper tape 7a and/or 7b is inserted into the widened gap G of the clamp 14, whereby the lower portion 16 of clamp 14 is adjacent the cavity of the zippered compartment and the upper portion 18 is protruding outwardly of, and positioned proximate to, the zippered closure 4. Then, clip 20 may be slid into its locked position along track 28 in direction B, so that the downward force of clip 20 compresses clamp 14 and urges lower portion 16 towards upper portion 18 so as to narrow gap G and thereby grip the portion of the zipper tape, zipper teeth and/or portions of the zippered compartment between the upper and lower portions 18, 16 of clamp 14. As the lower portion 16 is urged towards the upper portion 18, the zipper tape 7a and/or 7b (shown in FIG. 6) and/or adjacent portions of the zippered closure 4 become compressed between lower portion 16 and upper portion 18 of clamp 14, thereby anchoring the device 10 in place on the zippered closure 4. Once the anchor 12 of device 10 is installed on the zippered closure 4, the device may be securely held in its position along the zipper tape 7*a* and/or 7*b* and/or zipper teeth 8 of the zippered closure 4. Preferably, the device 10, once anchored, may not slide along the zippered closure 4 when a force is applied to the device 10. The device is then ready for releasably locking one or more sliders 1 of the zippered closure 4. Preferably, the device 10 may be installed on the zippered closure 4 at a position which is substantially adjacent the top stop 9 of the zippered closure, which is typically positioned at the end of the zipper tape 7*a* and 7*b* where the zipper slider 1 is positioned when the zippered closure 4 is closed, as may be seen for example in FIG. 5.

To lock the zippered closure, the releasable lock 21 releasably engages with slider head 2 of the slider 1 of the zippered closure 4. In use, the slider 1 is moved along the zipper tape 7*a* and 7*b* in direction D towards the slider guide 22 of the zipper locking device 10. As the slider 1 approaches the releasable lock 21, the front edge 3 of the slider 1 encounters the smooth ramp portion 24*a* of latch 24, allowing the slider head 2 to travel over the latch 24. As slider 1 continues to travel in direction D along the resiliently flexible slider guide 22, the head 2 of the slider is fully engaged when the rear edge 5 of the slider 1 passes over latch 24 of slider guide 22. Once the slider head 2 has passed over latch 24, the resilient slider guide 22 urges the latch 24 upwardly behind the slider head 2 so as to form a stop. In some embodiments of the present disclosure, the distal end 22*a* of the releasable lock 21 may include a wide surface so as to abut the interior surface I of the zipper tape 7 and prevent the slider guide 22 from flicking upwards upon making contact with slider head 2.

Advantageously, the zipper locking device disclosed herein releasably engages a portion of the body of the slider head 2, which enables use of the zipper locking device with a range of different zippered closures 4, as the design of the slider head 2 is relatively standardized across different zippered closures 4. The standardization of the design of a slider head 2 is in contrast to the non-standardization of the design of a pull tab (not shown), which is typically coupled to the slider head 2 by a pull tab coupling 2*a*. The applicant observes that pull tabs, which serve the function of enabling a user to pull the slider head 2 along the zipper track 6, may be made of a range of materials including but not limited to metal, cords, plastic and/or leather, may adopt a wide variety of shapes and designs, and the design of pull tabs is often informed by aesthetic considerations.

In contrast to the variation in the design of pull tabs, the body of a standard slider head 2, as known in the art, comprises an upper plate 2*b* coupled to a lower plate 2*c* by a vertical member (not shown). The lower plate 2*c* has a rearward edge 5 and a front edge 3. A pull tab coupling 2*a* is typically mounted to the upper plate 2*b* of the slider head 2, for coupling a pull tab to the slider head 2. The applicant notes that while the examples of embodiments of a zipper locking device disclosed herein feature locks and/or latches that releasably engage, for example, a rearward edge 5 of the lower plate 2*c* of the slider head 2, the present application is not intended to be limited to such embodiments. For example, the zipper locking devices disclosed herein may be configured to engage any portion of the body of a standard slider head 2, such as any portion of the upper and lower plates 2*b*, 2*c*, the pull tab coupling 2*a* and/or the vertical member, and any such embodiments are intended to be included in the scope of the present disclosure.

Referring to the embodiment illustrated in FIGS. 1-8, once the slider head 2 is fully received by the slider guide 22 of the releasable lock 21, the slider 1 cannot easily be removed from the lock 21 by moving the slider in direction E because the rear edge 5 of the slider abuts against the lip or ridge 24*b* of the latch 24. To release slider head 2 from the latch 24, in an operation typically requiring two hands, a user may grasp the clamp 14 of the device 10 in one hand and depress the resiliently flexible slider guide 22 in direction F, away from the interior surface I of the zipper track 6, so as to disengage the rear edge 5 of the slider head 2 from the lip 24*b* of the latch 24. Once the latch 24 is no longer hooked behind the rear edge 5 of the slider, the slider 1 may then be removed from the releasable lock 21 by sliding the slider in direction E away from lock 21 with the other hand.

Advantageously, this slider release operation requires some level of dexterity, for example by typically requiring depression of the resiliently flexible slider guide 22 with one hand while using the other hand to slide the slider 1 in direction E. While such an operation may be easily performed by a person with sufficient dexterity and coordination, such as a typical adult, most small children would not have sufficient strength in their hands or the coordination and dexterity required to perform this operation. As such, this device may prevent a small child from accessing the zippered compartment, while not hindering an adult from doing so. As well, the device 10 may sufficiently deter a thief from accessing a zippered compartment secured with the zipper locking device of the present disclosure, for example when the user of the zipper locking device is travelling in a crowded public space, due to the dexterity required to perform the unlocking operation and release the zipper slider from the lock.

It will further be appreciated that different configurations of the zipper locking device may be used so as to effectively lock zippered compartments having different configurations of zippered closures. For example, it may be the case that a zippered compartment includes a zippered closure having two sliders which are brought so as to be adjacent to one another when the zippered closure is in a closed position. For such a zipper configuration, the zipper locking device disclosed herein may be modified so as to include an anchor, such as anchor 12, in the middle of the device flanked by releasable locks 21 on each side of the anchor. In such a configuration, use of the device may include anchoring the device to a portion of the zippered closure which is somewhere in-between the two ends of the zippered closure 4, and then engaging each of the two zipper sliders 1 with each of the two respective releasable locks 21 on the device. Other possible variations of the zipper locking device are intended to be included in the scope of the present disclosure.

A further embodiment of the zipper locking device 100 is illustrated in FIGS. 9-18. Zipper locking device 100 shares many features of the embodiment of the zipper locking device 10 described above and illustrated in FIGS. 1-8, in that the device 100 includes an anchor 112 and a lock 121. Anchor 112 comprises a U-shaped clamp 114 having an upper portion 118 and a lower portion 116. In the embodiment shown in FIGS. 9-18, the clamp 114 is compressed by a rigid U-shaped clip 120, although it will be appreciated that other mechanisms for compressing the clamp, besides a rigid clip 120, may be used to perform the function of compressing the upper and lower contact surfaces 118*a*, 116*a* towards one another, as would be known to a person skilled in the art. Contact surfaces 118*a*, 116*a* of the upper and lower portions 118, 116 of clamp 114 may be roughened and/or may be resilient or include a resilient coating, so as to increase the frictional engagement between the contact surfaces 118*a*, 116*a* and the portion of the zipper track 6 gripped therebetween in the gap G between the upper and lower portions 118, 116 of the clamp 114. Furthermore, as shown for example in FIG. 9, the contact surfaces 116*a*, 118*a* may include an interlocking portion so as to further increase the frictional engagement between contact surfaces 116*a*, 118*a* and a portion of the zipper track 6 gripped therebetween.

Figure 10:
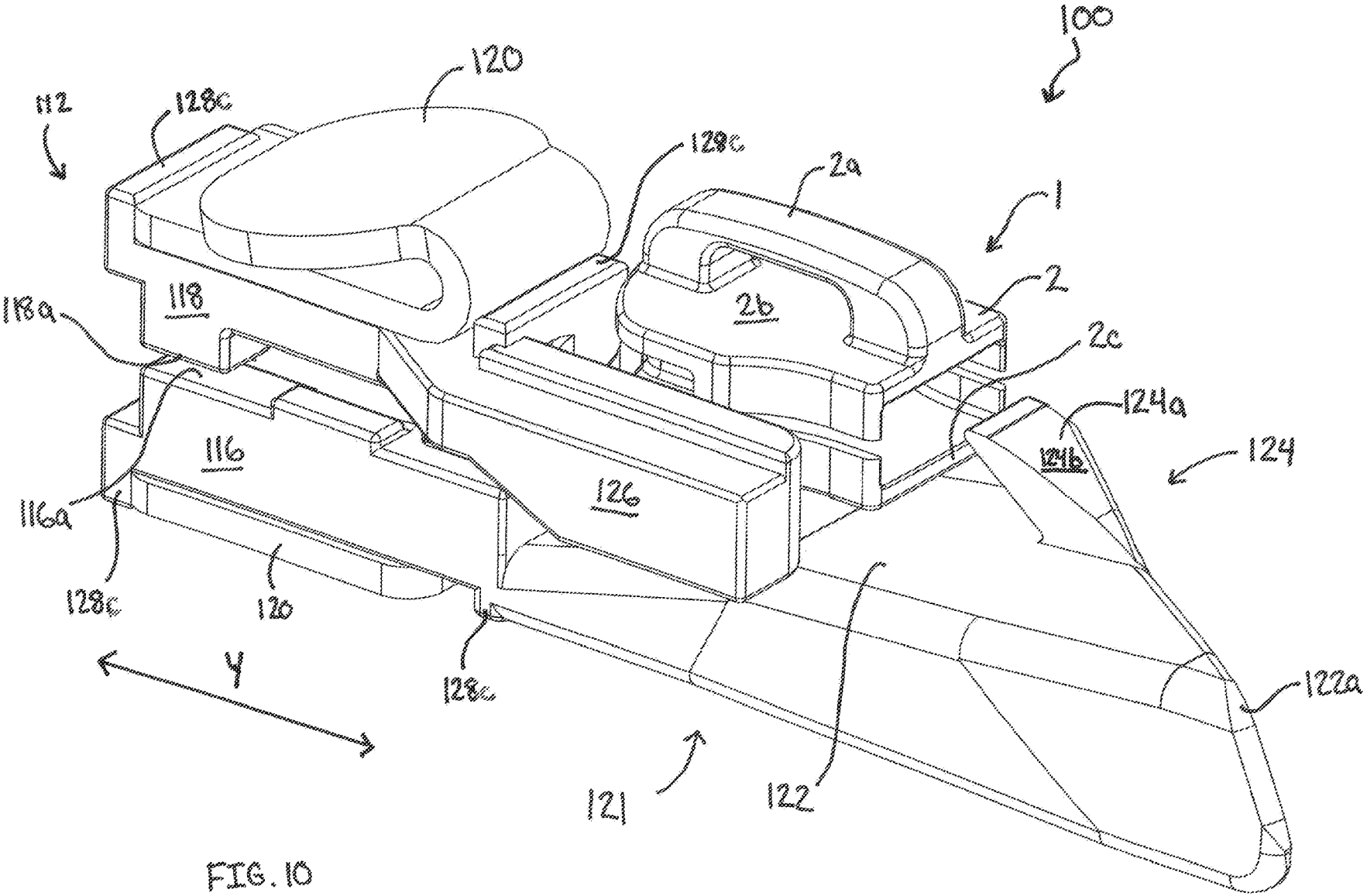
FIG. 10 is a further side perspective view of the zipper locking device of FIG. 9 with a zipper slider head engaged with the device.
Figure 11:
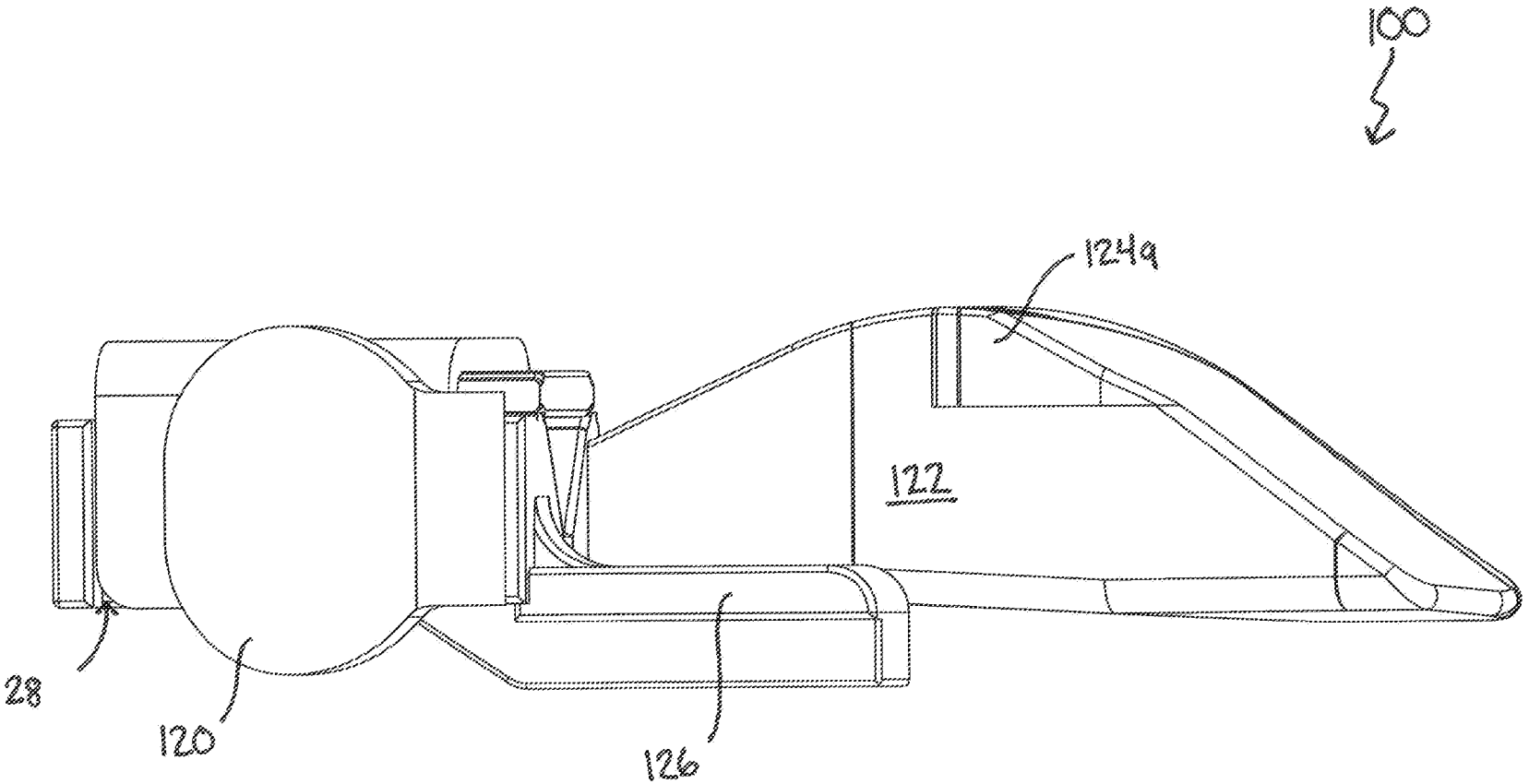
FIG. 11 is a top perspective view of the zipper locking device of FIG. 9.
Figure 12:
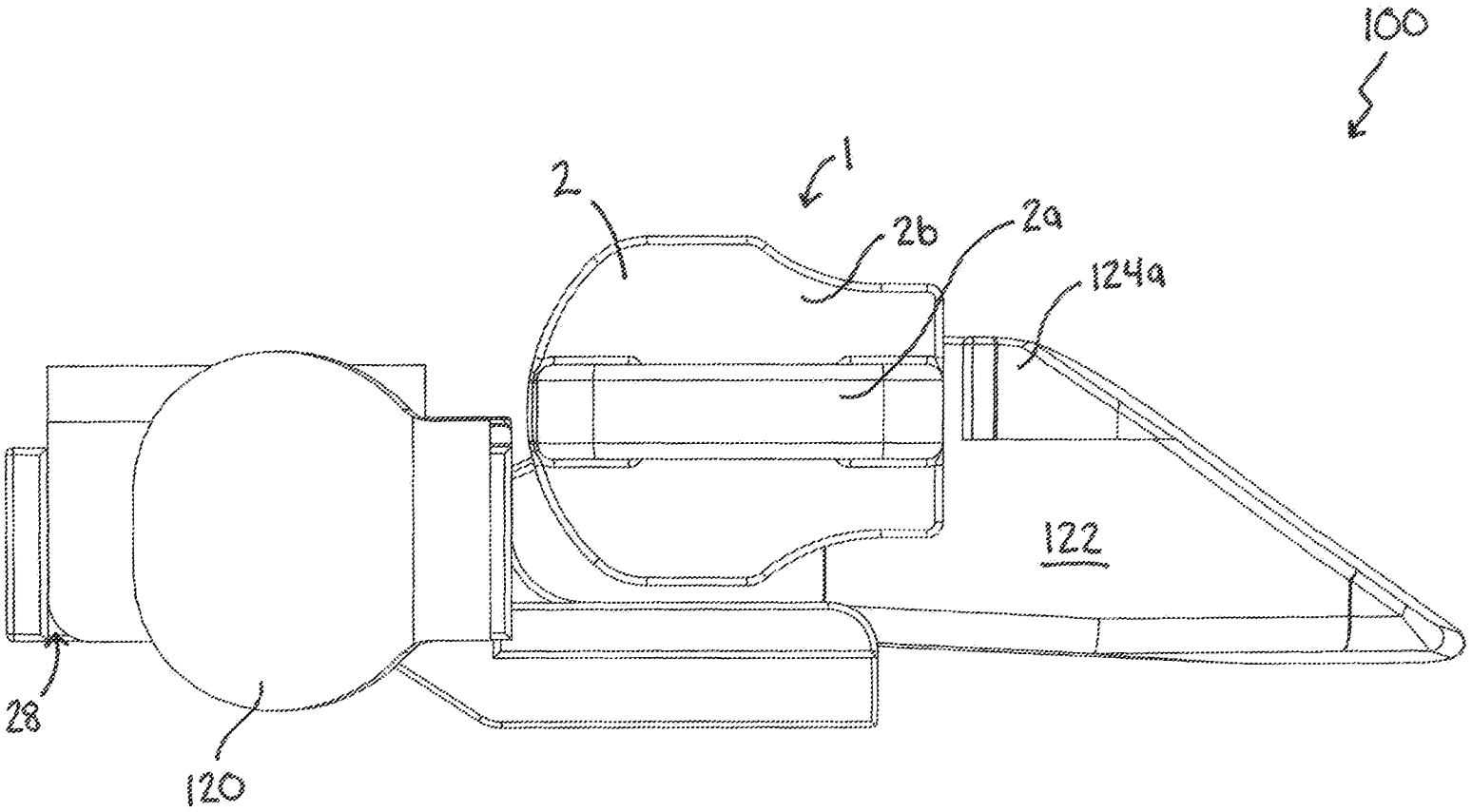
FIG. 12 is a top plan view of the zipper locking device of FIG. 9 with a zipper slider head engaged with the device.
Figure 13:
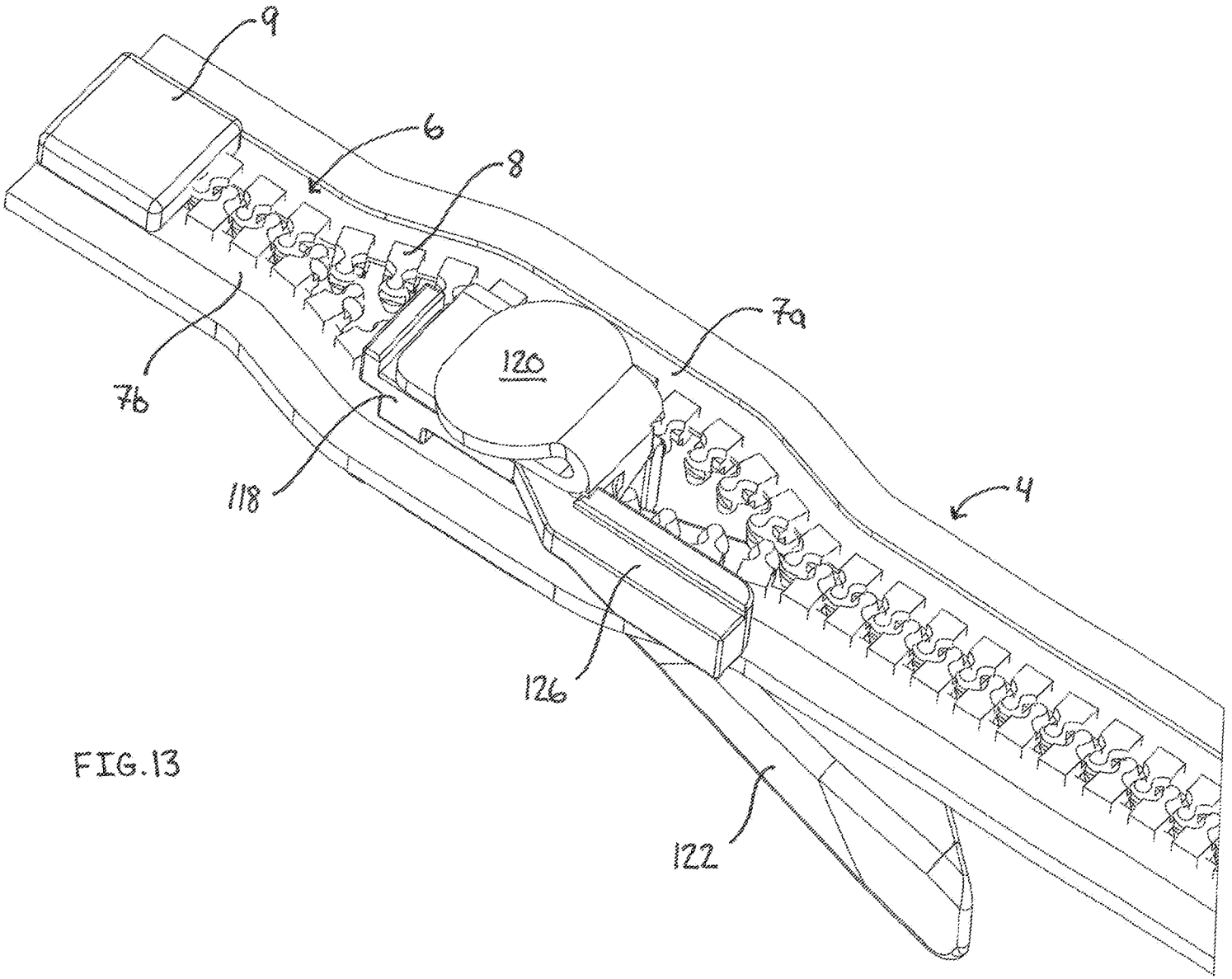
FIG. 13 is a top perspective view of the zipper locking device of FIG. 9 anchored to a zippered closure.
Figure 14:
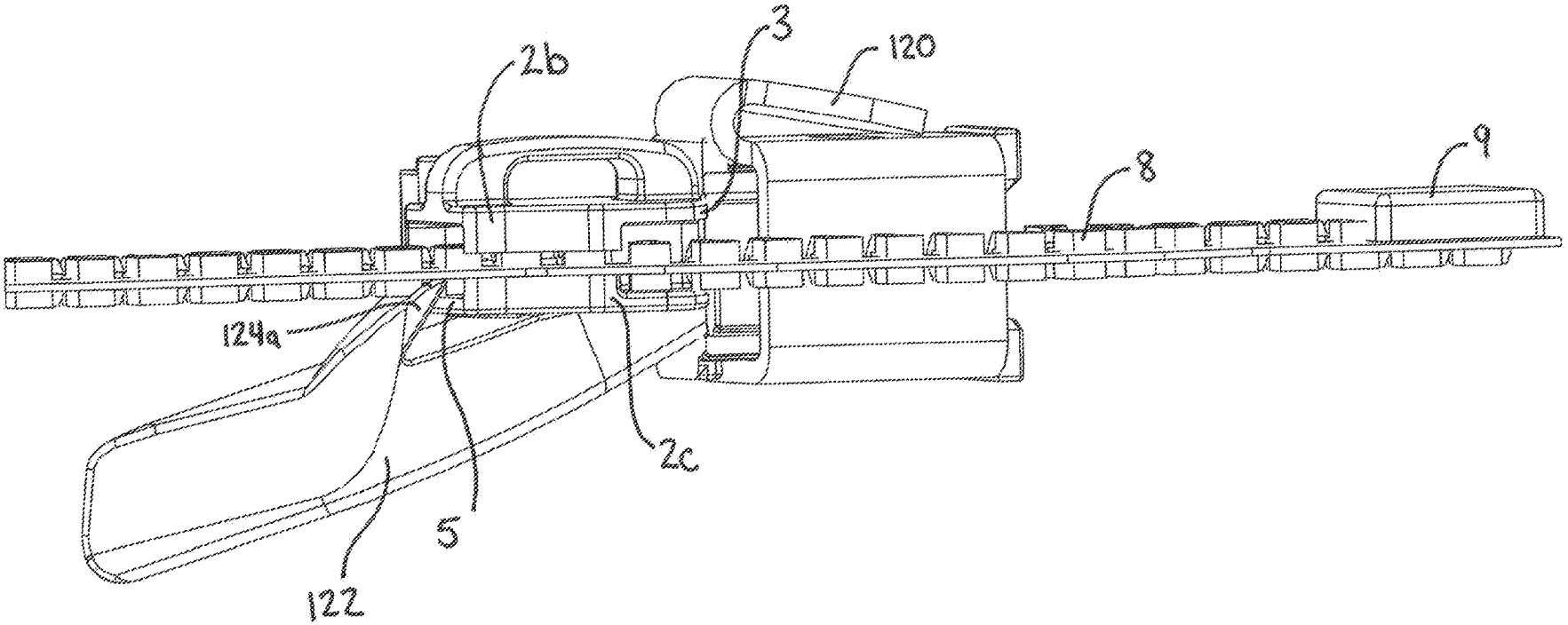
FIG. 14 is a side perspective view of the zipper locking device of FIG. 9 anchored to a zippered closure and engaged with a zipper slider head.
Figure 15:
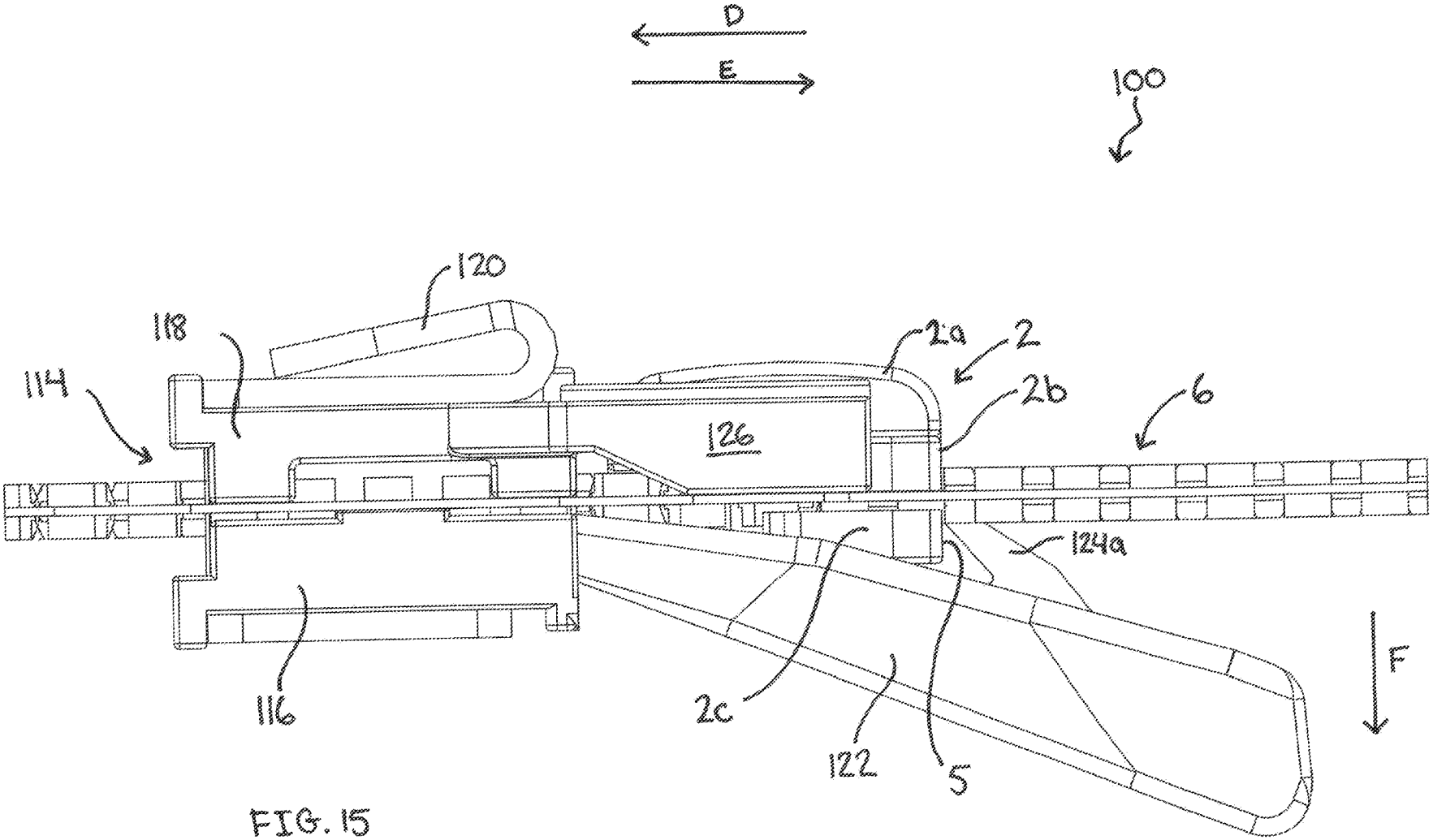
FIG. 15 is a side plan view of the zipper locking device of FIG. 9 anchored to a zippered closure and engaged with a zipper slider head.
Figure 16:
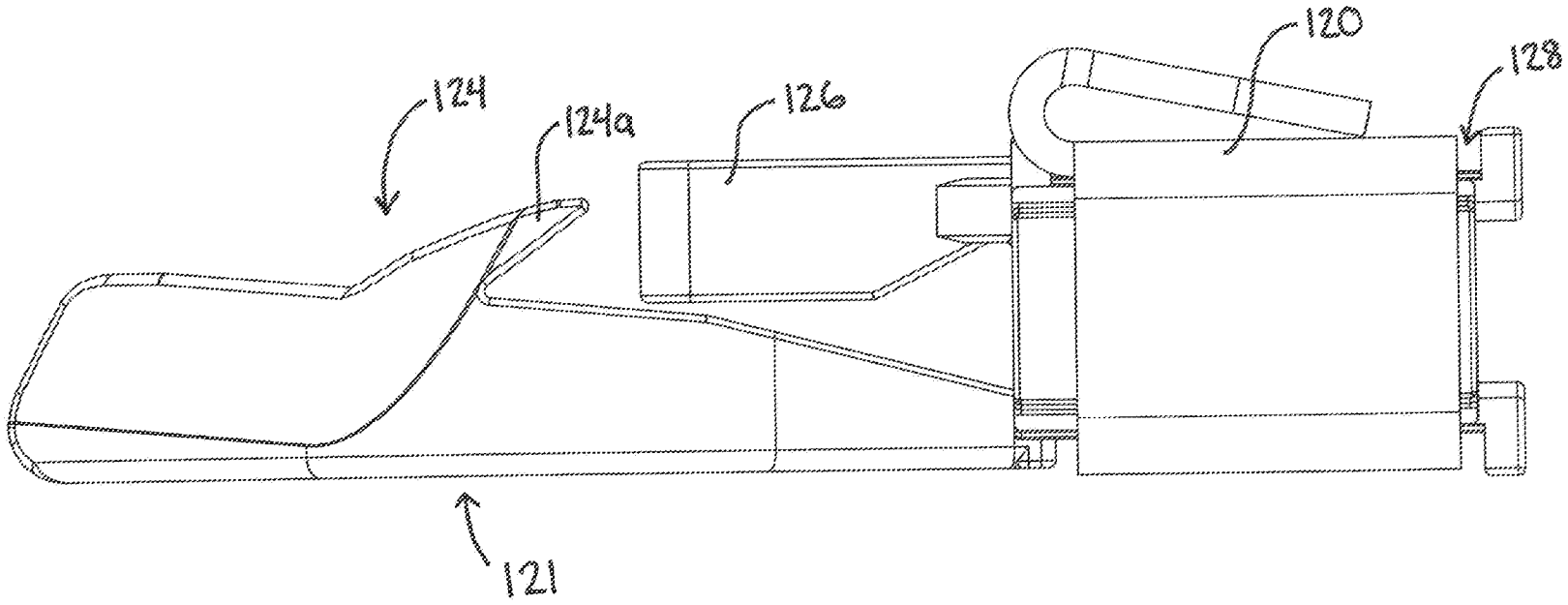
FIG. 16 is a side plan view of the zipper locking device of FIG. 9.
Figure 17:
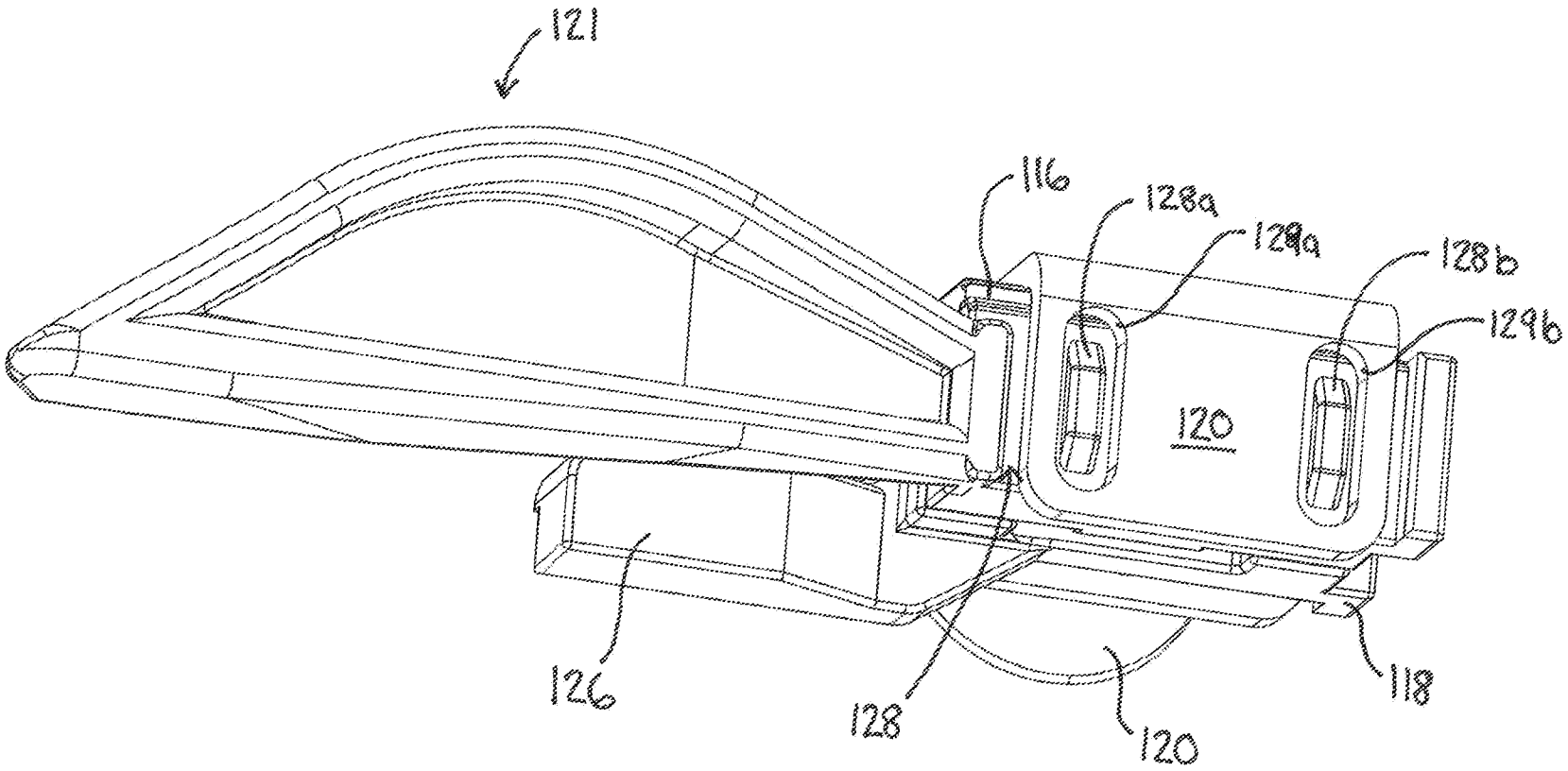
FIG. 17 is a bottom perspective view of the zipper locking device of FIG. 9.

The clamp 114 may optionally include a clip track 128 for receiving the clip 120. The clip track 128 may assist with retaining the clip 120 in place when installed on the clamp 114 of the anchor 112, as the ridges 128*c* defining the track 128 may prevent the clip 120 from sliding out of place in direction Y, such as shown in FIG. 10. However, it will be appreciated that clip tracks 28 or 128 are an optional feature and some embodiments of the zipper locking device 10 or 100 may not include a clip track. For embodiments of the device that utilize a clip 20 or 120 to compress the clamp 14 or 114, such devices may additionally or optionally include other features for retaining the clip 20 or 120 in place, such as protrusions 28*a*, 28*b* or 128*a*, 128*b* which engage with corresponding slots or receptacles 29*a*, 29*b* or 129*a*, 129*b* on the clip 120 when the clip 20 or 120 is installed on the clamp 14 or 114. However, again, the protrusions on the clamp and corresponding slots or receptacles on the clip are optional features and not required for retaining the clip 20 or 120 onto the clamp 14 or 114.

Zipper locking device 100 may also include a resilient retaining arm 126, which serves a similar function to the resilient retaining arm 26 in device 10 in that the resilient retaining arm 126 receives and engages a portion of the slider head 2 when slider head 2 is engaged with the device 100.

As with the device 10, the zipper locking device 100 includes a lock 121 extending cantilevered from the lower portion 116 of clamp 114. The lock 121 includes a resiliently flexible slider guide 122, the slider guide 122 having a distal end 122*a* distal from the anchor 112. The slider guide 122 also includes a latch feature 124 for engaging the body of the slider head 2. The latch 124 includes a hook 124*a*, the hook 124*a* angled towards the anchor 112 of the device. Unlike the device 10 illustrated in FIGS. 1-8, the device 100 does not include a separate ramp feature at the distal end 122*a* of the slider guide 122. Instead, the distal end 122*a* of device 100 comes to a smooth, rounded point, and the exterior surface 124*b* of the hook 124*a* is smooth and has a gradient, thereby forming a ramp, which enables the body of the zipper slider 2 to glide past the distal end 122*a* of the slider guide 122 and across the upper, ramp-like surface 124*b* of the hook 124*a*. As may be best viewed in FIGS. 10, 14 and 15, zipper slider head 2 engages with the device 100 by sliding the slider head 2 along the zipper track 6 in direction D towards the device 100 installed on a portion of the track 6 until the slider head 2 moves past the hook 124*a*. Once the slider head 2 is engaged in device 100, movement of the slider head 2 in direction E is prohibited by hook 124*a*, which engages the rear edge 5 of the lower plate 2*c* of the slider head 2. To release the slider head 2 from the device 100, the anchor 114 may be grasped in one hand and the resilient slider guide 122 may be manipulated through the zipper track 6 so as to deflect the resiliently flexible slider guide downwardly in direction F until the hook 124*a* disengages from the body of the slider head 2, thereby enabling the user to slide the slider head 2 in direction E.

Figure 18:
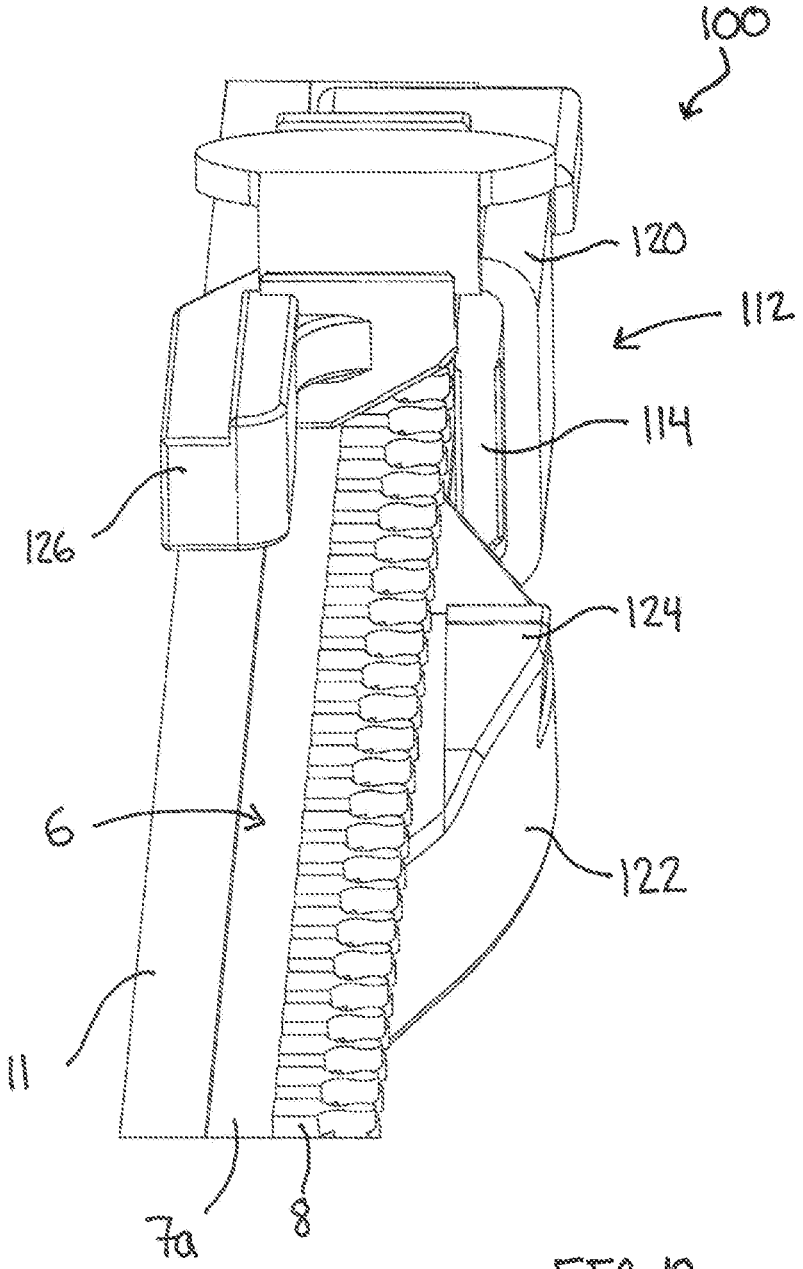
FIG. 18 is a front perspective view of the zipper locking device of FIG. 9 anchored to one half of a zipper tape of a zippered closure.

As best viewed in FIG. 18, in some embodiments of the device disclosed herein such as device 100, the clamp 114 of anchor 112 may be installed on only one half 7*a* or 7*b* of the zipper tape, so as to enable the installation of the U-shaped clamp 114 and U-shaped clip 120 onto the zipper tape 7*a* or 7*b*. It will be appreciated that the device 10 works in a similar manner and is only installed on one half 7*a* or 7*b* of the zipper tape. However, it will also be appreciated by a person skilled in the art that anchors utilizing different types of clamps, which are not secured by a rigid clip, may be devised to anchor the device to the zipper tape 6 and that such variants are intended to be included in the scope of the present disclosure, even if such variants are installed on both halves 7*a*, 7*b* of a zipper tape.

It will be appreciated by a person skilled in the art that other variations of the anchor and releasable locking mechanisms of the device disclosed herein, which have the respective functions of anchoring the device to the zippered closure 4 of the zippered compartment and releasably engaging the body of a standard slider head 2 of a standard zippered closure 4, are intended to be included within the scope of the present disclosure and that the invention disclosed herein is not intended to be limited to the specific embodiments disclosed.

What is claimed is:

1. A device for securing a compartment having a cavity and a non-child proofed zippered closure, the zippered closure including a zipper track, the zipper track in an original condition prior to installation of the device and having a first half zipper tape and a second half zipper tape, the first and second halves of the zipper tape comprising corresponding first and second sets of zipper teeth, the first and second sets of zipper teeth in opposed facing relation, and at least one slider head operatively coupled to the first and second sets of zipper teeth so as to selectively close and open the zippered closure by correspondingly selectively enmeshing and disengaging the first and second sets of zipper teeth, the at least one slider head comprising a body having an upper plate and a lower plate coupled to one another by a vertical member as viewed when the zipper tape is in a horizontal position, and a pull tab coupling for coupling a pull tab to the slider head body, the lower plate of the slider head body having a rearward edge, the device comprising:

an anchor configured to be removably mounted on to one half of the first and second halves of the zipper tape, the anchor including a single, U-shaped clamp having upper and lower portions defining a gap therebetween, wherein the gap is sized to snugly receive the one half of the zipper tape and the upper and lower portions of the clamp are urged toward one another to frictionally engage the clamp of the anchor with the one half of the zipper tape, and at least one releasable lock coupled to the anchor, the lock comprising a latch releasably retaining the body of the slider head, and wherein, when the anchor is removed from the one half of the zipper tape, the zipper tape retains its original condition.

2. The device of claim 1, wherein the latch receives and releasably retains the rearward edge of the lower plate of the slider body of the at least one slider head when the at least one slider head is engaged with the at least one releasable lock of the device.

3. The device of claim 2, wherein the zipper tape includes an exterior surface, exterior relative to the cavity of the compartment, and an opposite interior surface adjacent the cavity of the compartment, the anchor further including at least one resilient retaining arm extending cantilevered from the upper portion of the clamp so as to extend along the exterior surface of the zipper track when the anchor is mounted to the zipper tape, the retaining arm retaining the upper plate of the slider head when the lower plate of the slider head is retained by the latch of the anchor.

4. The device of claim 3 wherein the latch of the at least one releasable lock includes a resilient slider guide extending cantilevered from the lower portion of the clamp, the slider guide extending along the inner surface of the zipper track when the anchor is mounted to the zipper tape.

5. The device of claim 4 wherein the latch further comprises a lip, the lip located on a distal end of the slider guide distal from the lower portion of the clamp, the lip configured to releasably engage the rearward edge of the slider head.

6. The device of claim 5 wherein the distal end of the slider guide further comprises a ramp for guiding the slider head body along the ramp and the lip, wherein the lip is positioned between the ramp and the lower portion of the clamp and adjacent to the ramp.

7. The device of claim 4 wherein the latch further comprises a hook, the hook located on a distal end of the slider guide distal from the lower portion of the clamp and angled towards the anchor, the hook configured to releasably engage the rearward edge of the slider head.

8. The device of claim 7, wherein an exterior surface of the hook further comprises a ramp for guiding the slider head body along the exterior surface of the hook.

9. The device of claim 1, wherein the anchor includes a clip slidably mounted onto the clamp for urging the upper portion of the clamp towards the lower portion of the clamp.

10. The device of claim 9 wherein the clamp includes a slide track along which the clip slides relative to the anchor.

11. The device of claim 10 wherein the clamp includes at least one protrusion and the clip includes at least one corresponding receptacle, and wherein when the clip is slid along the slide track the at least one protrusion engages the at least one corresponding receptacle so as to slidably secure the clip to the clamp.

12. The device of claim 9 wherein the clip is a rigid clip.

13. The device of claim 1 wherein each portion of the upper and lower portions of the clamp includes a frictional contact surface, each contact surface being adjacent to the one half of the zipper tape when the anchor is mounted to the zipper tape, wherein each contact surface is textured to frictionally engage the zipper tape held in the gap of the clamp.

14. The device of claim 13 wherein the contact surface comprises a resilient material.

15. The device of claim 13 wherein the contact surface of the upper and lower portions of the clamp are interlocking when the anchor is mounted to the zipper tape to increase a frictional engagement between the contact surface of the upper and lower portions of the clamp and the one half of the zipper tape held within the gap of the clamp.

16. The device of claim 1 wherein the at least one releasable lock comprises first and second releasable locks, the first releasable lock extending from a first end of the anchor and the second releasable lock extending from a second end of the anchor, the second end distal from the first end of the anchor.

17. A method for securing a compartment having a cavity and a non-child proofed zippered closure, the zippered closure including a zipper track, the zipper track in an original condition prior to installation of the device and having a first half zipper tape and a second half zipper tape, the first and second halves of the zipper tape comprising corresponding first and second sets of zipper teeth, the first and second sets of zipper teeth in opposed facing relation, and at least one slider head operatively coupled to the first and second sets of zipper teeth so as to selectively close and open the zippered closure by correspondingly selectively enmeshing and disengaging the first and second sets of zipper teeth, the at least one slider head comprising a body having an upper plate and a lower plate coupled to one another by a vertical member as viewed when the zipper tape is in a horizontal position, and a pull tab coupling for coupling a pull tab to the slider head body, the lower plate of the slider head body having a rearward edge, the method comprising the steps of:

releasably anchoring the device of claim 7 to the one half of the zipper tape, engaging the slider head body of the at least one slider head with the latch of the device so as to prevent the slider head moving along the zipper tape away from the anchor of the device.

18. The method of claim 17, wherein the anchoring step further comprises the steps of:

mounting the clamp to the one half of the zipper tape that the slider guide extends along the interior surface and the retaining arm extends along the exterior surface of the zipper track, and wherein the slider head body engages the latch of the device by sliding the slider head body of the at least one slider head along the zipper track towards the anchor and over and past the ramp of the latch so as to engage the rearward edge of the lower plate of the slider head body with the hook of the latch.

* * * * *